United States Patent [19]

Sainato et al.

[11] 4,300,631

[45] Nov. 17, 1981

[54] FLEXIBLE CONTINUOUS GROUT FILLED PACKER FOR USE WITH A WATER INFUSION SYSTEM

[75] Inventors: Albert Sainato; Joseph Cervik; Leonard J. Prosser, Jr., all of Pittsburgh, Pa.

[73] Assignee: The United States of America as represented by the Secretary of the Interior, Washington, D.C.

[21] Appl. No.: 142,946

[22] Filed: Apr. 23, 1980

[51] Int. Cl.[3] ..... E21B 33/00

[52] U.S. Cl. ..... 166/187; 405/303

[58] Field of Search ..... 405/258, 260, 269, 303; 166/187, 191, 285; 102/333; 239/87

[56] References Cited

U.S. PATENT DOCUMENTS

| | | | |
|---|---|---|---|
| 3,280,916 | 10/1966 | Barrington | 166/187 |
| 3,556,215 | 1/1971 | Owens | 166/187 |
| 3,889,749 | 6/1975 | Hutchison | 166/187 |

*Primary Examiner*—Price C. Faw, Jr.
*Assistant Examiner*—Nancy J. Pistel
*Attorney, Agent, or Firm*—Thomas Zack; Donald A. Gardiner

[57] ABSTRACT

A borehole packer used with the water infusion system to control the movement of methane gas in an underground coal mine. A non-sparking plastic pipe or mandrel is mounted in each of a series of previously drilled generally horizontal boreholes. Normally this pipe is sealed by an encircling packer in the form of an expandable envelope. The mandrel and envelope are put in each borehole to a depth of about 110 to 185 feet with about 15 feet near the end away from the borehole entrance being opened. The flexible expandable envelope extends along almost all of the length of the hollow mandrel. In the volume between the outer surface of the mandrel and the envelope a hardenable fluid grout under pressure is pumped. As the grout fills this cavity the packer's flexible surface expands within the borehole until it forms a tight seal therewith. Because the grout is in an initial fluid state, it is flowable when forced into the packer and it can flow around irregular borehole surfaces. Eventually the grout forms a continuous seal with the packer's outer wall as it hardens to prevent any backflowing of infused water.

7 Claims, 2 Drawing Figures

FLEXIBLE CONTINUOUS GROUT FILLED PACKER FOR USE WITH A WATER INFUSION SYSTEM

BACKGROUND OF THE INVENTION

1. Field of the Invention

This invention is a mine borehole packer specifically designed for use with the water infusion process.

2. Description of the Prior Art

The water infusion process is a well known method used to control the movement of methane gas during mining operations in underground coal mines. Essentially it seeks to block the passage of the gas through the coalbed near the mine working face. It does this by first drilling a series of horizontal boreholes into the coalbed. Next in each borehole a hollow pipe is inserted. Then the pipe is packed between the pipe and the borehole i.e., the holes are prepared for infusion. And lastly water is pumped into and through the hollow pipe to exit from the far end thereof away from the working area. This water acts to prevent or block the flow of methane from the unmined part of the coalbed to the working face. The general object accomplished by this method is to keep the concentration of methane gas within the volume occupied by the miners and their equipment below one percent. Two United States Bureau of Mines publications describe this process in great detail and their contents are specifically incorporated by reference herein as background material. These publications are the Report of Investigations (RIs) entitled "Methane and Dust Control by Water Infusion" (RI 7640 published in 1972) and "Water Infusion of Coalbeds for Methane and Dust Control" (RI 8241 published in 1977).

The present invention is related to the step in the water infusion referred to above as the preparation for infusion. Previous packers commercially available for this purpose were constructed of metal and rubber with an overall length of about 5 feet. The ends were metal and the middle section (about 3.5 feet) an expansible rubber that acts to seal the borehole when inflated. Due to weight (each packer weights 45 lbs.) and manpower requirements, a typical 120 foot borehole would not contain these packers in a continuous abutting relationship. Normally many packers would be alternately joined by 5 feet pieces of metal pipes which results in less packers needed—e.g., twelve in the mentioned 120 feet borehole. One of the problems with this type of tradeoff is that only about 35 percent of the borehole is sealed by the 3.5 feet expandable middle sections. With less sealing of the borehole there is an increasing probability of water returning or short circuiting back along the borehole.

Several prior art patents are known which disclose grout filled packers used in boreholes. None employ the same structure as the present invention and are used for the same purpose. For example, the U.S. Pat. No. 1,630,470 to W. B. Clifford discloses an apparatus for breaking down ore bodies having a flexible envelope 25 of rubber which expands upon receiving a liquid via holes 36. The application of hydraulic pressure through bore 34 causes the envelope to contact the borehole with a high pressure area. Hence, the invention of Clifford is used to fracture the ore body by expanding a pressurized envelope while in the present invention the packer fluid is independent of the fluid in the mandrel and does not require a plug at end of the mandrel as in Clifford. These structural differences exist because the two inventions are used for different purposes—one to fracture the ore and one to act as a seal for a water infusion process.

Other U.S. patent references such as: No. 1,808,162 (Frantz); No. 3,918,522 (Suman); No. 2,634,113 (Joy); and No. 2,238,825 (Semler) disclose expandable structures, like packers, which could be inflated to fix various devices in boreholes. None relate to continuous inflatable packers used in water infusion processes.

SUMMARY OF THE INVENTION

The apparatus forming the subject matter of this invention has a centrally hollow mandrel made from a plastic material resistant to sparking. When placed in an underground pre-drilled mine borehole, water under pressure is forced through the hollow portion of the mandrel to block the natural flow of methane gas. Encircling the mandrel and extending substantially its entire length is an expandable envelope that can be inflated by a fluid grout material to act as a packer for the system. There is also a fed system so that grout may be forced into the envelope in a controlled manner.

The primary object of this invention is an improved packer specifically designed for use with a water infusion system.

DESCRIPTION OF THE DRAWING

FIGS. 1*a* and 1*b* show the preferred embodiment of the invention with several sections in cross-section views and also having transverse cuts at three positions. FIG. 1*a* shows the output end, while FIG. 1*b* shows the input end of a preferred embodiment of the invention.

Figure 6A:
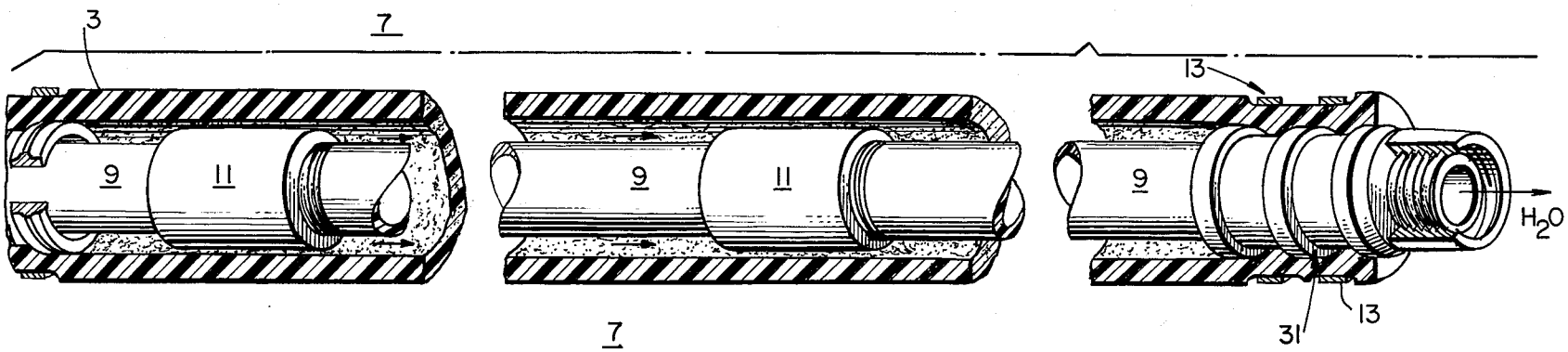
Figure 6:
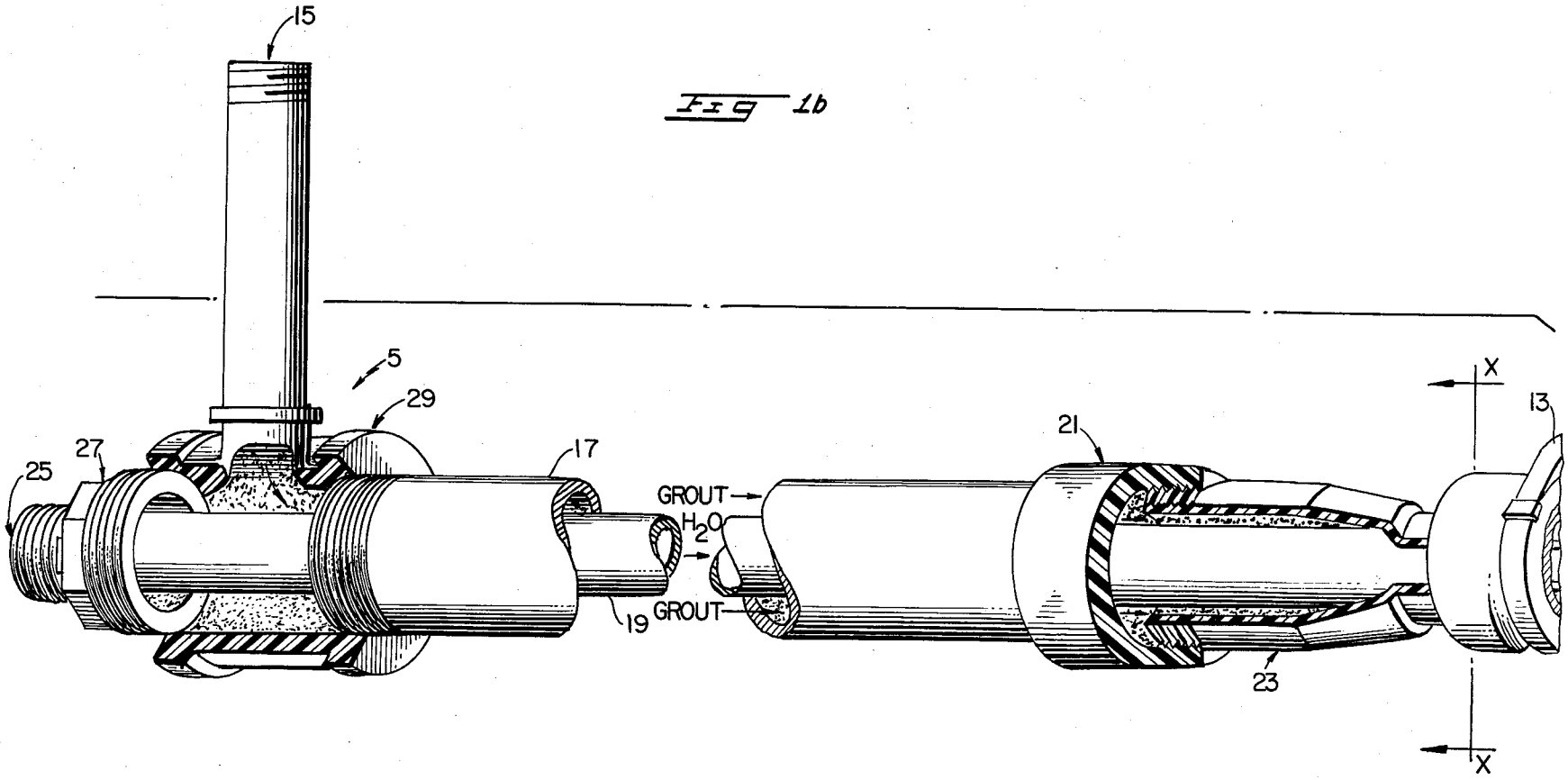

The basic components of the preferred embodiment include the central mandrel 1, the expandable envelope 3, and the feed system 5 to supply material to the envelope. When in an operative mode all of the components to the right of the vertical dashed line x—x would normally be placed within the previous drilled horizontal borehole 7 of the coal bearing earth. Those members to the left of line x—x are in the mine working area and available to the mine operators.

The mandrel 1 is made of a series of hollow pipe sections 9 which are longitudinally aligned with each other in the borehole and joined together by couplings 11. The mandrel has been broken at two places since its true length would be too great to show on scale. The purpose of each pipe is to carry the water used in the water infusion process from the mine working area to the end of the borehole. Since the mandrel, as well as its envelope 3, are left in the borehole during mining operations, they may be struck by the mining machine. To prevent sparks—and the possibility of methane gas explosions—the mandrel, couplings, envelope and all other components should be made from materials resistant to sparking when impacted by metal mining tools. For example, in one embodiment the mandrel sections were made from one inch diameter polyvinyl chloride pipe with a fitting coupling of the same material and the envelope from a rubber hose two inches in inside diameter.

The envelope may be made of an expandable rubber hose, plastic tube, or any other non-sparking material that will expand and retain grout under pressure. Each of the envelope's ends are clamped by a pair of clamps 13. As the grout is pumped it expands the envelope whose outside surface then contacts the borehole to act as a sealing packer. Pressures of about 750 psi (gauge) have been used in actual experiments to pressurize the grout. The length of the packer-envelope may vary from a few feet to over 100 feet and usually covers many sections of the mandrel supplying water to the coalbed. Other materials which have or could be used to construct the envelope include plastic (6–15 mils thickness), canvas, or brattice cloth.

The pressurized liquid materials which may be used to inflate the packer-envelope include a cement slurry or any other hardenable fluid such as synthetic resin. Whatever, the particular material is, it is pumped into the fed system through grout feed pipe 15 from an external source (not shown). It then flows in the annular volume between the outer steel pipe 17 and the inner steel pipe 19 in the direction of the arrows. At the steel coupling 21, which joins the steel adapter 23, the flow path narrows down. The front end of the adapter is held at its forward end by the first pair of envelope clamps. In order to insure a non-slip fit with the envelope, the outer front surface of the adapter may have serrated edges. Its back outer surface may be threaded as shown to allow the coupling to be tightly jointed therewith. Normally, but not necessarily, the annular volume for the grout flow can be considered concentric with the center of the mandrel 9.

Other features depicted in the drawing include the inlet opening 25 to receive the water under pressure; and the reducer 27 to support the pipe 19 and also to plug one end of the volume containing the grout between the two pipes 17 and 19. There is a steel tee 29 which supports the grout feed pipe at one end where it joins with the steel pipe 17 and reducer 27. At the far front end of the packer there is a polyvinyl chloride pipe end connector 31 which has appropriate outer ridges to allow the two front clamps to firmly sandwich the front end of the envelope between them and the mandrel.

In an actual mining operation the sequence of events would essentially be to first drill a series of spaced horizontal boreholes into the surface to be mined at depths ranging from about 125 to 200 feet. Next, the illustrated mandrel, envelope, couplings, etc., that are illustrated are inserted into each borehole leaving about 15 feet open at the back end of the hole. Then a cement or any other hardenable grout in liquified form is pumped via opening 15 to fill the annular volume between the plastic mandrel and expandable envelope. After the grout material hardens to form a continuous packing seal along the length of the borehole, the center hole of the mandrel is used to convey water from the mining area to its opened end. Due to the structure of this mandrel and the envelope the water and grout never contact each other.

It should be apparent that the packer or envelope seal the hole along the entire length of the packer to prevent water from short circuiting along the hole to return to the mine opening. This sealed length is also substantially—except for about 15 feet near its end—about the entire length of the borehole. Because of the expandable continuous nature of the packer envelope, the irregularities of the contacting borehole wall are compensated for by the packer's surface to form an extremely tight seal. As mine cutting operations occur, the packer/mandrel must remain in the hole after infusion takes place to prevent water from flowing out of the coalbed. The mining machine cutter will in its normal operation cut into the packer and systematically destroy it. Since the mandrel and packer/envelope are constructed of materials—plastic and rubber, for example—that will not spark the ever present danger of a methane explosion is substantially reduced. Further, the hardened grout in the packer will provide some sealing, alibi less than initially, of the borehole as the mining cutter chop it away. All in all the simple packer arrangement of this water infusion method provides all the desired objectives of an effective safe seal that can easily be inserted into a borehole.

Although this invention has been disclosed in its preferred embodiment using specific materials for the packer and mandrel with a particular type of construction, none should be used to limit the scope and extent of the invention which is to be measured only by the claims that follow:

We claim:

1. A water infusion packer system for use in an underground coal mining borehole comprising:

a mandrel made of a spark resistant material mounted in said borehole, said mandrel being connected to means for conveying water from the mine working area to and through the mandrel to the back section of the borehole;

an expandable packer envelope encircling the mandrel along substantially its entire length located in the borehole, said envelope being fixed to the mandrel near its front and back sections with a volume of grout fillable space being provided around the mandrel therebetween; and means to convey a liquid grout to the fillable space to cause the envelope to expand outwardly to contact and seal the borehole along its length while not communicating with the water in the mandrel.

2. The system of claim 1 wherein the mandrel is made up of a series of elongated plastic sections horizontally aligned with each other and coupled together by plastic fittings.

3. The system of claim 2 wherein a tapered adaptor is mounted at one end to encircle the mandrel section nearest the borehole opening and forms part of the means to convey a liquid grout.

4. The system of claim 3 wherein said adaptor has its narrow end encircling the mandrel at the front end where the envelope is fixed thereto.

5. The system of claim 1 wherein the expandable packer envelope is made up of a rubber hose section, said hose being clamped to the mandrel at its opposite ends.

6. The system of claim 1 wherein the mandrel is circular in cross-section along its internal water conveying volume with the envelope being circular in cross section and concentric therewith to form an annular volume in cross-section for the grout fillable space.

7. The system of claim 1 wherein the envelope is made from a spark resistant material whose outer diameter is approximately twice as great as the outer diameter of the mandrel's means for conveying water.

* * * * *